US005183210A

United States Patent [19]

Takeishi et al.

[11] Patent Number: 5,183,210

[45] Date of Patent: Feb. 2, 1993

[54] ELECTROSTATIC SPRAY COATING APPARATUS

[75] Inventors: Hideo Takeishi, Minoo; Sigeki Houseki, Izumi; Isao Matsubara, Suita, all of Japan

[73] Assignee: Ohgi Paint Trading Co., Ltd., Osaka, Japan

[21] Appl. No.: 587,950

[22] Filed: Sep. 24, 1990

[30] Foreign Application Priority Data

Oct. 12, 1989 [JP] Japan ..... 1-265978

[51] Int. Cl.[5] ..... B05B 5/04

[52] U.S. Cl. ..... 239/703; 239/300; 239/301

[58] Field of Search ..... 239/700-703, 239/290, 292, 293, 298, 300, 301

[56] References Cited

U.S. PATENT DOCUMENTS 4,458,844 7/1984 Mitsui ..... 239/703
4,572,437 2/1986 Huber et al. ..... 239/703
4,601,921 7/1986 Lee ..... 239/293

FOREIGN PATENT DOCUMENTS 0192099 8/1986 European Pat. Off. .
2193447 2/1988 United Kingdom .

*Primary Examiner*—Andres Kashnikow
*Assistant Examiner*—Karen B. Merritt
*Attorney, Agent, or Firm*—Nixon & Vanderhye

[57] ABSTRACT

An electrostatic spray coating apparatus for ejecting an atomized liquid paint toward an object to be coated with a paint has a rotary head for ejecting an atomized liquid paint toward the object. The rotary head comprises a rotary member, adapted to rotate about a center axis thereof, for discharging a liquid paint in the form of an annular thin-film therefrom toward the object during rotation thereof. A gas ejecting unit is provided for ejecting a gas flow so as to atomize the liquid paint discharged from the rotary member. The gas ejecting unit includes an adjusting portion for adjusting the direction of the gas flow, which is to be ejected from the ejecting unit, with respect to the center axis of the rotary member.

7 Claims, 3 Drawing Sheets

ELECTROSTATIC SPRAY COATING APPARATUS

BACKGROUND OF THE INVENTION

The present invention relates generally to an electrostatic spray coating apparatus for electrostatically coating the surface of an object with an atomized liquid paint. More particularly, the invention relates to a rotary head of an electrostatic spray coating apparatus for ejecting an atomized liquid paint toward an object which is to be coated with a paint.

UK Patent Publication No. GB A 2193447 discloses an exemplary electrostatic spay coating apparatus in which a cup-shaped or disk-shaped rotary head having integrated inner and outer cup members is provided for discharging a liquid paint in the form of an annular thin-film from an inner peripheral surface of the inner cup member, and in which an annular slit for leading and ejecting a gas flow for atomizing the liquid paint discharged from the inner peripheral surface of the inner cup member is defined between the inner and outer cup members of the rotary head.

The above-mentioned electrostatic spray coating apparatus, however, has a disadvantage in that the gas flow can be led through the annular slit only in a predetermined direction with respect to the axis of rotation of the rotary head, resulting in a fixation of condition of atomization which are to be adjusted to atomize in an optimum state the liquid paint in accordance with various coating conditions.

In order to adjust the width of an ejection pattern of a liquid paint or the state of atomization of the liquid paint, it has been necessary to change the pressure or speed of ejection of the gas flow. In this case, however, changes in the pressure or speed of ejection of the gas flow tend to cause the state of atomization of the liquid paint to be instable, resulting in a deteriorated quality of a coating film formed on the object surface due to formation of ultrafine particles of liquid paint having non-uniform sizes.

SUMMARY OF THE INVENTION

It is therefore an object of the present invention to provide a rotary head of an electrostatic spray coating apparatus for ejecting an atomized liquid paint toward an object to be coated with a paint, which can adjust the state of atomization of a liquid paint so as to obtain an optimum atomization of the liquid paint in accordance with various coating conditions without changing the pressure or speed of ejection of a gas flow for atomizing the liquid paint.

It is another object of the present invention to provide a rotary head of an electrostatic spray coating apparatus for ejecting an atomized liquid paint toward an object to be coated with a paint, which can adjust the state of atomization of a liquid paint by changing a direction of ejection of a gas flow for atomizing a liquid paint so as to obtain an optimum atomization of the liquid paint in accordance with various coating conditions.

According to the present invention, the above-mentioned objects can be achieved by an electrostatic spray coating apparatus for electrostatically coating an object with an atomized liquid paint, comprising a rotary head for ejecting an atomized liquid paint toward the object, the rotary head including: a rotary member, adapted to rotate about a center axis thereof, for discharging a liquid paint in the form of an annular thin-film therefrom toward the object during rotation thereof; and means for ejecting a gas flow so as to atomize the liquid paint discharged from the rotary member, the ejecting means including means for adjusting a direction of the gas flow, which is to be ejected from the ejecting means, with respect to the center axis of the rotary member.

The above-mentioned objects can be also achieved by a rotary head of an electrostatic spray coating apparatus for ejecting an atomized liquid paint toward an object to be coated with a paint, the rotary head comprising: a rotary member, adapted to rotate about a center axis thereof, for discharging a liquid paint in the form of an annular thin-film therefrom toward the object during rotation thereof; and means for ejecting a gas flow so as to atomize the liquid paint discharged from the rotary member, the ejecting means including means for adjusting a direction of the gas flow, which is to be ejected from the ejecting means, with respect to the center axis of the rotary member.

In the rotary head having the above-mentioned construction, the state of atomization of a liquid paint can be adjusted by changing the direction of ejection of the gas flow with respect to the center axis of the rotary member so as to obtain an optimum of atomization of the liquid paint in accordance with various coating conditions. Namely, since an optimum atomization of the liquid paint can be obtained without changing the pressure or speed of ejection of the gas flow, ultrafine particles of liquid paint having a substantially uniform size can be formed due to a stabilized state of atomization. Accordingly, it is possible to form a coating film on the object surface with high quality.

Preferably, the rotary member has one end and inner and outer peripheral surfaces, and is adapted to discharge a liquid paint in the form of an annular thin-film from the inner peripheral surface thereof through the one end thereof toward the object, while the ejecting means is adapted to eject the gas flow from the outer peripheral surface of the rotary member through the one end thereof.

Further objects, features and advantages of the present invention will become apparent from the following description of the preferred embodiments of the present invention as illustrated in the accompanying drawings.

DESCRIPTION OF THE PREFERRED EMBODIMENTS

Figure 1:
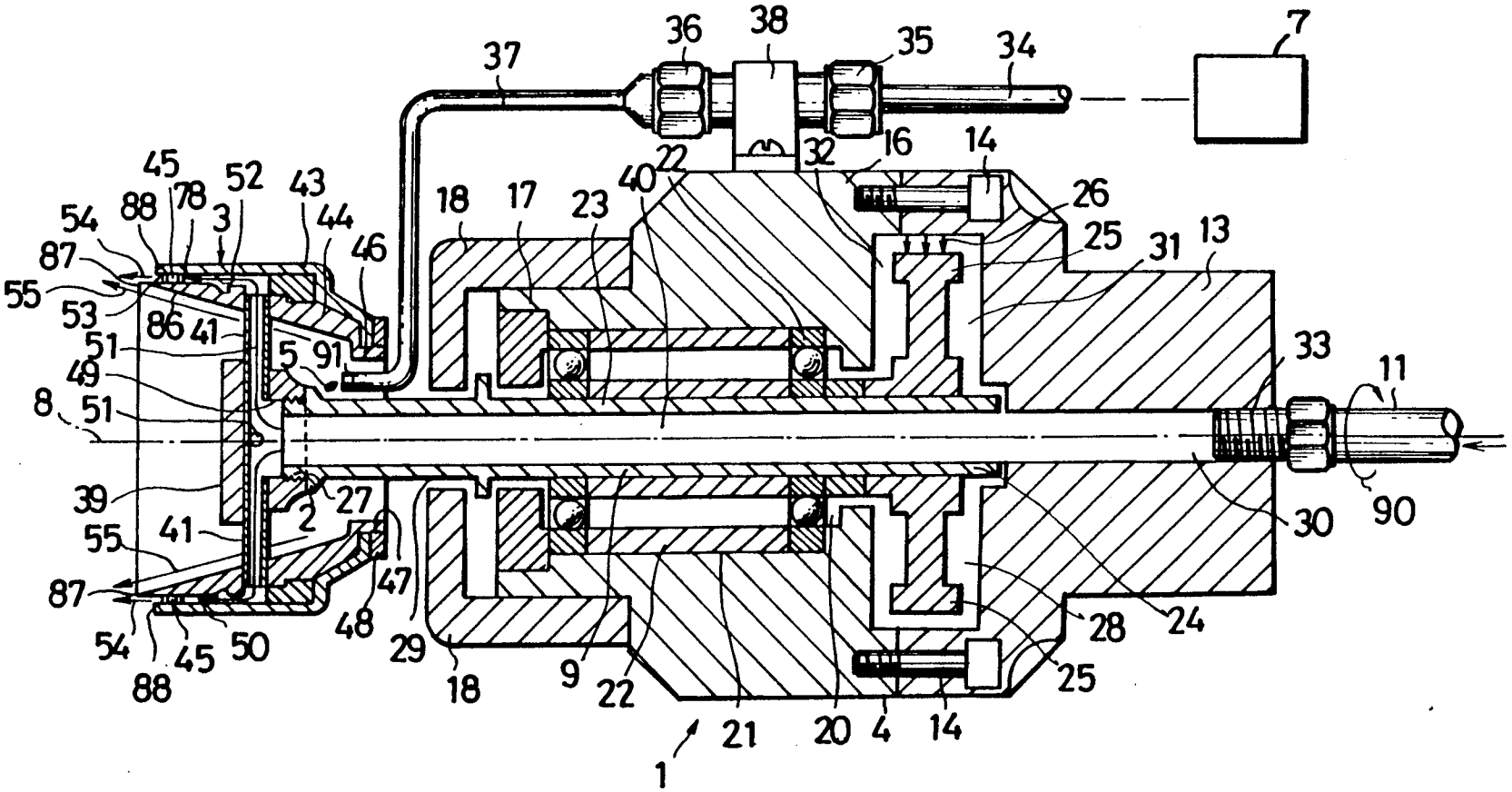
FIG. 1 is a side section view showing an embodiment of an electrostatic spray coating apparatus having a rotary head according to the present invention.

Referring to FIG. 1, there is shown a preferred embodiment of the electrostatic spray coating apparatus 1 according to the present invention. The apparatus 1 comprises a body 4 which is provided at one end 2 thereof with a cup-shaped rotary head 3 for ejecting an atomized liquid paint toward an object (not shown)

which is to be coated with a paint. The electrostatic spray coating apparatus comprises a high-voltage generator (not show) for creating a high electric field between the rotary head 3 and the object.

A paint supplying device 7 is provided for supplying a paint 5 to the rotary head 3, and a drive device 9 is provided for rotating the rotary head 3 around its center axis 8.

The drive device 9 includes a bearing unit 22 which is mounted on an inner wall 21 of the body 4 which defines an annular space 20 therein. Rotatably supported in the bearing unit 22 is a hollow shaft 23 which is provided at one end 24 with an impeller 25 disposed in a space 28 formed in the body 4. The shaft 23 can be rotated by a drive force created by ejecting a pressurized gas flow toward the impeller 25 in a direction of the arrow 26.

The rotary head 3 has inner and outer peripheral surface and is in screw connection with the hollow shaft 23 at the other end 27 of the shaft. Accordingly, the rotary head 3 and the shaft 23 together are rotated at a predetermined number of revolutions.

The body 4 comprises shell members 13 and 16 which are fixed to each other via a plurality of bolts 14, and a cover member 18 which is press-fitted to a convex portion 17 of the shell member 16. The shell members 13 and 16 have concave portions 31 and 32, respectively, which define the space 28. The shaft 23 extends through an aperture 29 formed in the cover member 18.

The shell member 13 has a gas passage 30 which is connected to an air supply pipe 11 through a connector 33 which is in screw connection with the shell member 13. A pressurized gas such as air is supplied from a gas supply (not shown) through the pipe 11 into the gas passage 30. The hollow shaft 23 has a gas passage 40 which extends through the shaft 23 and is open to the opposite ends 24 and 27 thereof. The gas passage 40 is in communication with the gas passage 30 of the shell member 13.

The paint supplying device 7 comprises pipes 34 and 37 for leading the paint from a paint tank (not shown) to the rotary head 3. The pipes 34 and 37 are connected to each other through connectors 35 and 36 which are supported by a bracket 38 attached to the the shell member 16.

Figure 2:
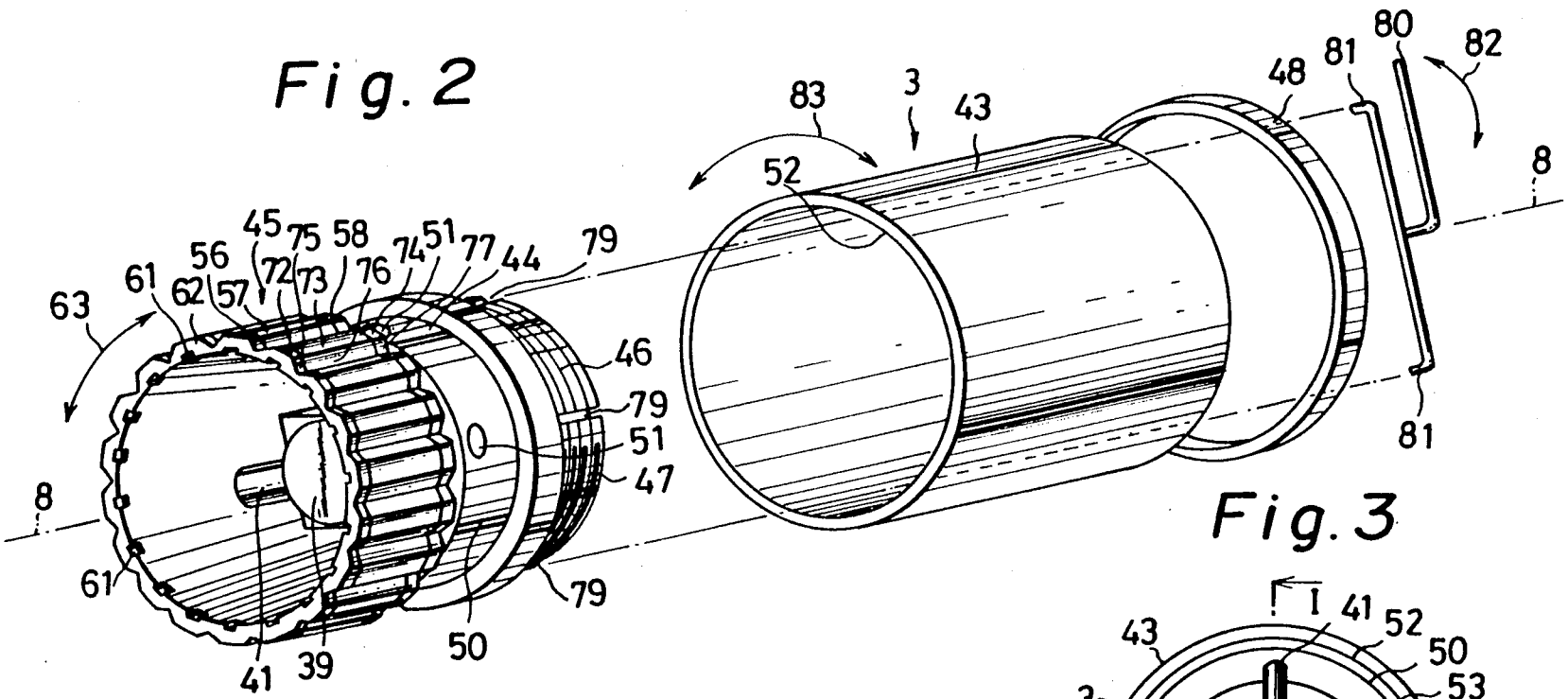
FIG. 2 is an exploded perspective view of the rotary head shown in FIG. 1.
Figure 3:
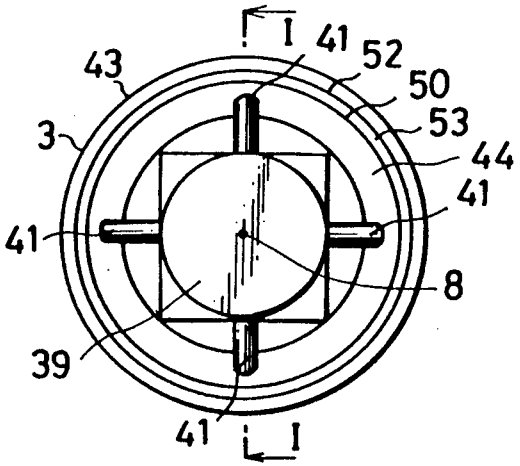
FIG. 3 is a front elevational view of the rotary head shown in FIG. 1.

As best shown in FIG. 2, the rotary head 3 comprises a cylindrical outer cup member 43 and an inner cup member 44. The inner cup member 44 is coaxially housed in and fixed to the outer cup member 43 through a fixing ring member 48 which is in screw connection with the inner cup member 44 at a thread portion 47 formed on a base end 46 of the inner cup member 44. The inner cup member 44 has an outer peripheral surface 50, while the outer cup member 43 has an inner peripheral surface 52. In the assembled state, the cup members 43 and 44 define an annular space 53 between the outer peripheral surface 50 and the inner peripheral surface 52. The annular space 53 is open at tip ends 88 and 87 of the cup members 43 and 44. An adjusting unit 45 is provided between the outer cup member 43 and the inner cup member 44 so as to adjust a direction of a gas flow, which is to be ejected from the rotary head, with respect to the center axis 8 of the rotary head 3.

The inner cup member 44 also has an inner peripheral surface 86 which is so tapered as to have a radius which increases toward the tip end 87 of the inner cup member 44. Namely, the inner peripheral surface 86 and the outer peripheral surface 50 of the inner cup member 44 intersect to each other at the tip end 87 of the inner cup member 44.

The rotary head 3 further comprises a center member 39 which is in screw connection with the shaft 23. The inner cup member 44 has therein a cavity 49 and is fixedly connected to the center member 39 through a plurality of hollow ribs 41 arranged radially. Each of the ribs 41 has therein a gas passage 51 which is connected at one end thereof to the cavity 49 of the center member 39 and is also connected at the other end thereof to the annular space 53 between the cup members 43 and 44. Therefore, the pressurized gas introduced into the gas passage 40 of the shaft 23 from the pipe 11 can be further introduced into the annular space 53 between the cup members 43 and 44 through the gas passages 51 of the ribs 41.

Figure 4:
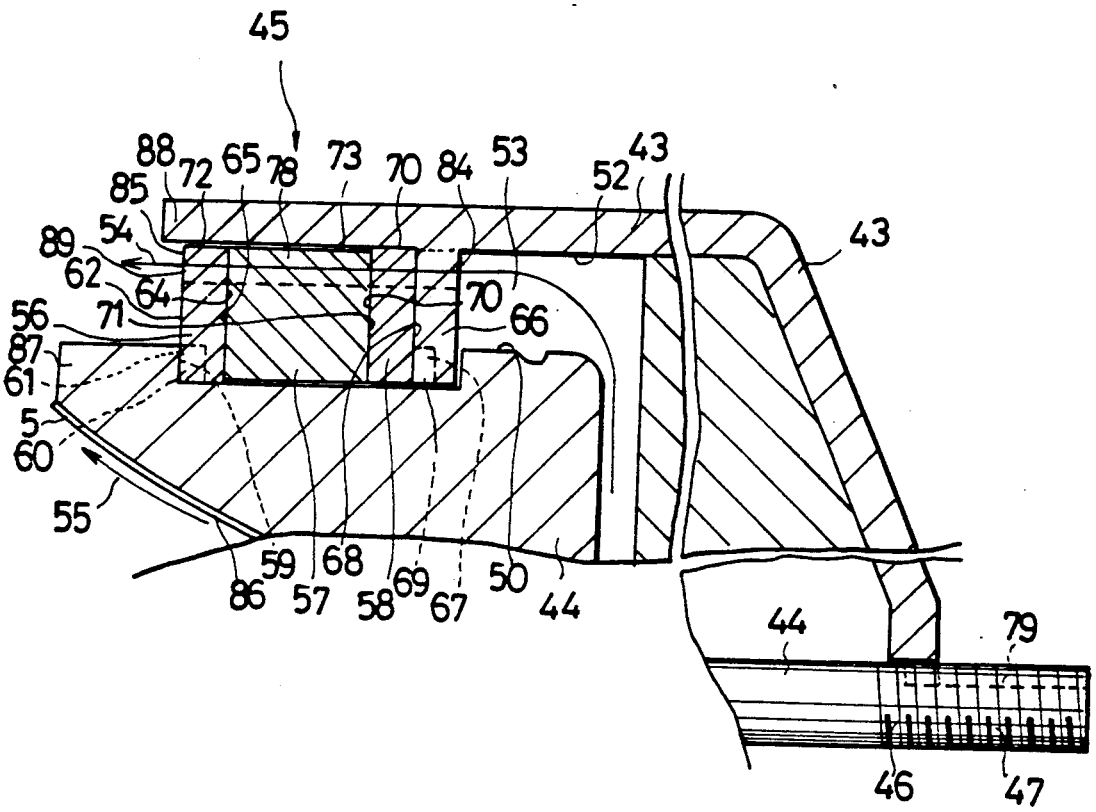
FIG. 4 is an enlarged section view of a main part of the rotary head.

As best shown in FIG. 4, the adjusting unit 45 is disposed within the annular space 53 between the outer peripheral surface 50 of the inner cup member 44 and the inner peripheral surface 52 of the outer cup member 43. In this embodiment, the adjusting unit 45 includes opposite end-ring members 56 and 58 and a mid-ring member 57 which is fixed at opposite ends thereof to the end-ring members 56 and 58, respectively, by means of, for example, adhesives.

The end-ring member 56 is formed at its end face 62 thereof with a plurality of recesses 61 which are in engagement with a plurality of protrusions 60 formed on a stepped portion 59 of the outer peripheral surface 50 of the inner cup member 44, respectively, whereby securing the end-ring member 56 to the inner cup member 44. Alteratively, a plurality of recesses may be formed on the stepped portion 59 of the inner cup member 44, and in this case, a plurality of protrusions are formed on the end face 62 of the end-ring member 56.

The end-ring member 58 is formed at its end face 68 with a plurality of protrusions 69 which are in engagement with a plurality of recesses 67 formed in a flange 66 which, in turn, is integrally formed on the inner peripheral wall 52 of the outer cup member 43, whereby securing the end-ring member 58 to the outer cup member 43. Alternatively, a plurality of recesses may be formed on the end face 68 of the end-ring member 58, and in this case, a plurality of protrusions are formed on the flange 66.

The end-ring members 56 and 58 are preferably made of a rigid material such as a metal or the like, while the mid-ring member 57 is preferably made of an elastically deformable material such as silicon rubber, urethan rubber, or the like. The mid-ring member 57 may be made of a plastically deformable material.

As shown in FIG. 2, the ring members 56, 57 and 58 integrated to each other are formed at their outer peripheral faces 72, 73 and 74 with a plurality of grooves 75, 76 and 77, respectively, which are spaced from each other in the circumferential direction of the ring members. The grooves 75, 76 and 77 of the ring members 56, 57 and 58, as well as the inner peripheral surface 52 of the outer cup member 43 define a plurality of gas passages 78 for ejecting the gas flow from the rotary head 3.

Figure 5:
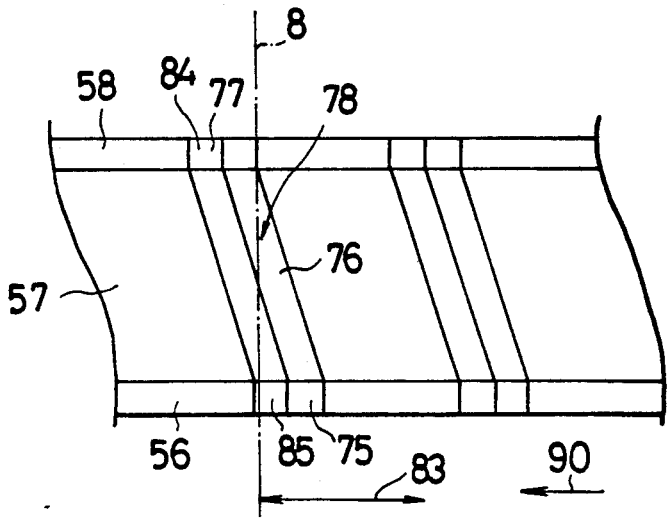
FIG. 5 is a view for explaining an adjusting operation of the rotary head shown in FIG. 1.

As shown in FIG. 2, the inner cup member 44 is formed at the threaded portion 47 thereof with a plurality of engagement grooves 79 which are engageable with tip ends 81 of a tool 80. Accordingly, it is possible to rotate the outer cup member 43 in opposite directions of the arrow 83, with the inner cup member 44 maintained stationary by means of the tool 80 engaged there-with. Rotating the outer cup member 43 with respect to the inner cup member 44 causes the relative rotation of the end-ring members 56 and 58, while deforming either elastically or plastically, as shown in FIG. 5, resulting in the relative displacement of the grooves 75 and 77 in the circumferential directions of the ring members as well as the deformation of the grooves 76 between the grooves 75 and 77. As the result, the gas passage defined in the grooves 75, 76 and 77 is deflected with respect to the center axis 8 of the rotary head 3, as shown in FIG. 5. Namely, the direction or angle of ejection of the gas flow can be changed with respect to the center axis of the rotary head 3. That is, by deflecting the gas passages, the angle of the ejected gas flow is variably adjusted with respect to the circumferential direction of rotation of the rotary member between first and second angles wherein at least one of the angles has an axially extending flow component and a circumferentially extending flow component for imparting a swirl to the ejected gas flow.

Although, in FIGS. 2 and 5, the ring members 56, 57 and 58 of the adjusting unit 45 are illustrated in larger size than the actual size thereof for the easy understanding of the present invention, it is preferable to make the ring members 56 and 58 as thin as possible.

Explanation will now be made as to the use and operation of the electrostatic spray coating apparatus having the above-described construction.

In use of the electrostatic spray coating apparatus, the outer cup member 43 as well as the fixing ring member 48 is loosened with respect to the inner cup member 44. In this state, the tool 80 is engaged with the grooves 79, and the ejection angle of the gas flow is adjusted with respect to the axis 8 so as to obtain an optimum atomization of the liquid paint in accordance with the coating conditions. Then, the outer cup member 43 is secured to the inner cup member 44 by means of the fixing ring member 48. Thereafter, the rotary head 3 in which the ejection angle of the liquid paint is adjusted and fixed, is assembled to the shaft 23.

During the spray coating operation of the electrostatic spray coating apparatus, the rotary head 3 is rotated in one direction about the center axis 8 thereof. In this state, a liquid paint 5 is fed from the tip end 91 of the pipe 37 of the paint supplying device 7 to the inner peripheral surface 86 of the inner cup member 44. Due to rotation of the inner cup member 44 at a predetermined speed, the liquid paint 5 fed to the inner peripheral surface 86 of the inner cup member 44 forms a thin-film extending on the whole area of the inner peripheral surface 86 of the inner cup member 44 under centrifugal force. As a result, the liquid paint is discharged in a direction of the arrow 55 from the inner peripheral surface 86 of the inner cup member 44 through the tip end 87 thereof in the form of a thin-film.

Further, at the same time, a pressurized gas is fed into the annular space 53, as described above. The pressurized gas is then introduced into the gas passages of the adjusting unit 45 and ejected therefrom through a space 89 between the tip end 87 of the inner cup member 44 and the tip end 88 of the outer cup member 43 in a direction of the arrow 54. As shown in FIG. 1, since the direction of ejection of the gas flow and the direction of discharge of the liquid paint intersect to each other at acute angle in front of the tip end 87 of the inner cup member 44, the liquid paint is atomized. Since the atomization of the liquid paint is performed by the gas flow which is ejected from the adjusting unit 45 at a substantially constant speed, ultrafine particles of the liquid paint having a substantially uniform size can be stably created.

In this way, the atomized liquid paint is forced to the object to be coated with a paint by the action of a high electric field, which is created between the rotary head 3 and the object, and is finally adhered to the object surface.

While the invention has been described in conjunction with specific embodiments thereof, it is evident that many alternatives and modifications will be apparent to those skilled in the art in light of the foregoing description. For example, the gas ejecting means may be disposed within the cup-shaped rotary member so as to atomize a liquid paint which is discharged, in the form of an annular thin-film, from an inner peripheral surface of the rotary member. Accordingly, it is intended to include all such alternatives and modifications as fall within the spirit and scope of the appended claims.

What is claimed is:

1. A rotary head for an electrostatic spray coating apparatus for ejecting an atomized liquid paint toward an object to be coated with paint, the rotary head comprising:

a rotary member, adapted to rotate about a center axis thereof, for discharging the liquid paint therefrom in the form of an annular thin-film and toward the object during rotation thereof; and means for ejecting a gas flow for atomizing the liquid paint discharged from said rotary member, said ejecting means including an adjusting means for adjusting the ejected gas flow with respect to the center axis of the rotary member;

said adjusting means of said ejecting means defining a plurality of elongated gas passages about an outer peripheral surface of said rotary member, each of said gas passages having a first opening for receiving therein a gas supply and a second opening, opposite to the first opening, for discharging the gas flow from the corresponding as passage, the relative positions of the first and second openings of each of the gas passages being changeable in a circumferential direction about said center axis so as to deflect the corresponding gas passage with respect to the longitudinal direction of the center axis of the rotary member.

2. A rotary head according to claim 1, wherein said rotary member at one end has inner and outer peripheral surfaces, said rotary member being further adapted to discharge the liquid paint in the form of an annular thin-film from said inner peripheral surface thereof through the one end thereof toward the object, said ejecting means being adapted to eject the gas flow from said outer peripheral surface of said rotary member through said one end thereof.

3. A rotary head according to claim 2, wherein said ejecting means includes an outer member which surrounds said outer peripheral surface of said rotary member to define an annular space between said rotary member and said outer member and which is rotatively displaceable relative to said rotary member about the center axis of said rotary member, said annular space being in communication with the gas supply, and wherein said adjusting means includes a generally deformable ring body disposed between said rotary member and said outer member, the gas passages through said ring body between opposite ends of said ring body, the opposite ends of said ring body being fixed to said rotary member and said outer member, respectively, so that the relative positions of the opposite ends, and the relative positions of said first and second openings of each of the gas passages, can be changed by relatively rotating said outer member and said rotary member, thereby uniformly deflecting the longitudinal directions of the gas passages with respect to the center axis of said rotary member.

4. A rotary head according to claim 3, wherein said ring body includes opposite rigid end-ring members and a deformable mid-ring member fixed at opposite ends to said rigid end-ring members, respectively, said rigid end-ring members being fixed to said rotary member and said outer member, respectively.

5. A rotary head according to claim 2, wherein said outer peripheral surface is cylindrical and said inner peripheral surface is tapered such that the inner and outer peripheral surfaces intersect each other adjacent said one end of said rotary member.

6. A rotary head according to claim 2 further comprising a paint supply means for supplying a liquid paint to the inner peripheral surface of said rotary member during rotation of said rotary member.

7. A rotary head according to claim 3, including a hollow shaft extending coaxially relative to said center axis, a plurality of hollow ribs extending radially between said rotary member and said hollow shaft coaxially securing said rotary member and said shaft one to the other, said annular space being in communication with said gas supply through the interior of said hollow ribs and the interior of said hollow shaft.

* * * * *